US007850590B2

(12) United States Patent
Mackel et al.

(10) Patent No.: US 7,850,590 B2
(45) Date of Patent: Dec. 14, 2010

(54) SEPARATOR HAVING A RIGIDLY CONNECTED STATOR, AN ELASTIC SUPPORT AND ULTRA SOCKETS

(75) Inventors: Wilfried Mackel, Lippetal/Herzfeld (DE); Helga Tietz, Oelde (DE)

(73) Assignee: Gea Westfalia Separator GmbH, Oelde (DE)

( * ) Notice: Subject to any disclaimer, the term of this patent is extended or adjusted under 35 U.S.C. 154(b) by 0 days.

(21) Appl. No.: 12/298,786

(22) PCT Filed: Apr. 25, 2007

(86) PCT No.: PCT/EP2007/054047

§ 371 (c)(1),
(2), (4) Date: May 27, 2009

(87) PCT Pub. No.: WO2007/125066

PCT Pub. Date: Nov. 8, 2007

(65) Prior Publication Data

US 2009/0233780 A1 Sep. 17, 2009

(30) Foreign Application Priority Data

Apr. 28, 2006 (DE) ..... 10 2006 020 467

(51) Int. Cl.
*B04B 9/04* (2006.01)
*B04B 9/14* (2006.01)
*B04B 15/02* (2006.01)

(52) U.S. Cl. ..... 494/14; 494/15; 494/82; 494/83; 494/84

(58) Field of Classification Search ..... 494/1, 494/12, 16, 20, 82–84, 14, 15; 68/23.1, 23.3; 464/180; 210/144, 363; 74/572, 574
See application file for complete search history.

(56) References Cited

U.S. PATENT DOCUMENTS

| | | | | | |
|---|---|---|---|---|---|
| 1,174,955 | A | * | 3/1916 | Balzer | 384/199 |
| 1,585,566 | A | | 5/1926 | Sindl | |
| 2,015,784 | A | * | 10/1935 | Brown | 384/536 |
| 2,040,351 | A | | 5/1936 | Williams | |
| 2,265,053 | A | | 12/1941 | Anderson | |
| 2,487,343 | A | * | 11/1949 | Kopf | 384/535 |
| 2,534,738 | A | * | 12/1950 | Scott | 384/196 |
| 2,556,317 | A | * | 6/1951 | Cook | 384/535 |
| 2,827,229 | A | | 3/1958 | Blum | |
| 3,003,831 | A | * | 10/1961 | King et al. | 384/536 |
| 3,595,470 | A | * | 7/1971 | Shapiro | 494/5 |

(Continued)

FOREIGN PATENT DOCUMENTS

| | | |
|---|---|---|
| CH | 107681 | 3/1925 |

(Continued)

*Primary Examiner*—Charles E Cooley
(74) *Attorney, Agent, or Firm*—Barnes & Thornburg LLP

(57) ABSTRACT

A separator includes a centrifuge drum having a vertical rotational axis and a feed line to feed a product to be centrifugally processed. Further included is a drive spindle having an impeller to drive the centrifugal drum, which drive spindle is rotatably mounted in a housing by a bearing device and which is supported on a machine frame by an elastic support. Also included is a lubrication arrangement and a drive device including an electric drive motor having a stator and a motor rotor which is aligned with the drive spindle.

20 Claims, 3 Drawing Sheets

U.S. PATENT DOCUMENTS

| | | | | | |
|---|---|---|---|---|---|
| 4,193,536 | A | * | 3/1980 | Kubota | 494/14 |
| 4,322,030 | A | * | 3/1982 | Jacobson et al. | 494/15 |
| 4,568,324 | A | * | 2/1986 | Williams | 494/82 |
| 4,946,433 | A | * | 8/1990 | Gorodissky et al. | 494/15 |
| 5,800,070 | A | * | 9/1998 | Nilsson et al. | 384/535 |
| 6,224,533 | B1 | * | 5/2001 | Bengtsson et al. | 494/82 |
| 6,428,460 | B1 | * | 8/2002 | Appelquist et al. | 494/82 |
| 6,626,814 | B1 | * | 9/2003 | Setterberg | 494/15 |
| 6,988,980 | B2 | * | 1/2006 | Moss | 494/15 |
| 7,300,396 | B2 | * | 11/2007 | Pitkamaki et al. | 494/15 |
| 7,588,526 | B2 | * | 9/2009 | Kleimann et al. | 494/15 |
| 2009/0131237 | A1 | * | 5/2009 | Soetebier et al. | 494/46 |
| 2009/0233780 | A1 | * | 9/2009 | Mackel et al. | 494/15 |
| 2009/0253565 | A1 | * | 10/2009 | Kohlstette et al. | 494/12 |

FOREIGN PATENT DOCUMENTS

| | | | | |
|---|---|---|---|---|
| CH | 329841 | | | 5/1958 |
| DE | 545 120 | C | | 2/1932 |
| DE | 596 402 | C | | 5/1934 |
| DE | 1 057 979 | | | 2/1956 |
| DE | 1 038 990 | | | 9/1958 |
| DE | 38 34 222 | A1 | | 4/1990 |
| DE | 43 14 440 | C1 | | 6/1994 |
| EP | 215585 | A1 | * | 3/1987 |
| FR | 1287551 | | | 3/1962 |
| GB | 368247 | | | 8/1929 |
| GB | 2146784 | A | * | 4/1985 |
| GB | 2 277 700 | | | 11/1994 |
| SU | 1388094 | A1 | * | 4/1988 |
| WO | WO 99/42221 | | | 8/1999 |
| WO | WO 02/096566 | A1 | | 12/2002 |

* cited by examiner

SEPARATOR HAVING A RIGIDLY CONNECTED STATOR, AN ELASTIC SUPPORT AND ULTRA SOCKETS

BACKGROUND AND SUMMARY

The invention relates to a separator that includes a centrifuge drum with a vertical rotational axis and a feed line for a product to be centrifugally processed. The separator further includes a drive spindle for the drum that is rotatably mounted in a housing by a bearing arrangement and which is elastically supported on a machine frame. Also included is an electric motor which has a stator and a rotor which is aligned with the drive spindle.

Such separators, which are also suitable for industrial use, such as in continuous operation, are known from the prior art.

The known systems include designs in which the drum, the drive spindle and the electric drive motor are rigidly connected to form one structural unit which is then elastically supported in its entirety on a machine frame. Examples of such prior art are disclosed by FR 1.287.551, DE 1 057 979 and DE 43 14 440 C1. It is disadvantageous that such arrangements are relatively large in size and large masses have to be moved in terms of oscillation.

DE 2005 001 539 U1 presents a separator having a wrap around gear mechanism.

Further background also includes CH 329 841, CH 107 681, U.S. Pat. No. 2,040,351 and WO 99/42 221 A1.

The present disclosure relates to a compact separator which can be manufactured cost-effectively and in which the motor area can be divided from the bearing area or bearing space.

The present disclosure relates to a separator that includes a centrifuge drum having a vertical rotational axis and a feed line to feed a product to be centrifugally processed. Further included is a drive spindle to drive the centrifugal drum, which drive spindle is rotatably mounted in a housing by a bearing device and which is supported on a machine frame by an elastic support. Also included is a drive device including an electric drive motor having a stator and a motor rotor which is aligned with the drive spindle. The stator is rigidly connected to the machine frame. The motor rotor, the drive spindle, the centrifuge drum, and the housing form a unit which is supported on the machine frame by the elastic support and which unit oscillates during an operation of the separator. The bearing device is arranged between the motor and the drum.

According to the just-mentioned disclosure, the stator is rigidly connected to the machine frame. The motor rotor, the drive spindle, the centrifuge drum and the housing form a unit which is elastically supported on the machine frame and oscillates during operation. The entire bearing device, for the drive spindle, is arranged between the motor and the drum.

Since the stator is directly supported on the machine frame, and the motor rotor is seated directly on the drive spindle, a particularly compact, vertical design can be implemented using only a small number of components.

The arrangement of the bearing device between the motor and the drum permits an axially short design in which the bearing area and the motor are, or can be, structurally separated from one another. The lubrication of the bearing device can be separated from the motor, which is not the case in arrangements in which the motor is arranged between a neck bearing and a footstep bearing. Nevertheless, the motor can still be supported with its stator directly in the machine frame.

DE 596 402 A, DE 545 120 A and GB 368 247 disclose the measure that the stator is supported directly on the machine frame and the motor rotor is seated directly on the drive spindle. However, since the bearings are arranged axially in the motor area or since bearings are located axially on each side of the motor, the motor area cannot be separated from the bearings. The present disclosure provides an advantage in that the motor area can be separated from the bearings.

The oscillating unit is configured in such a way that the center of rotation, for example, of the precision movement, is at the axial and radial center point of the rotor or motor rotor and does not differ far from the center point. This is done in such a way that the motor rotor can no longer rotate freely in the machine housing. This ensures that, for example, during operation, contact cannot occur between the motor rotor and the drum.

As a result of this measure, the separator drive is configured in such a way that the relative conditions between the stator and the motor rotor, which were brought about by the design according to the present disclosure, are reduced to a minimum. Thus, it becomes possible to arrange the motor rotor in the oscillating system and to arrange the stator in or on the non-oscillating machine frame, which permits a particularly compact and cost-effective design. Furthermore, the oscillating mass of the system is kept small, since only the rotor of the motor is involved in it.

The coordination, in terms of oscillation, is configured "supercritically" so that the oscillating system composed of the drum, drive spindle and motor rotor is mounted and configured with a low natural resonant frequency in the ultra sockets, wherein the natural resonant frequency is relatively far below the customary operating rotational speed range of the drum. An advantage is that during operation the system runs in a relatively stable way with only small deflections since the resonant frequency is already run through when the system starts up at a relatively low rotational speed of the drum.

The motor rotor is connected directly to the drive spindle in a rotationally fixed fashion or is embodied in one piece therewith. Elements which lengthen the design, such as a clutch, can be dispensed with in this way. In addition, the manufacturing costs are also reduced further.

Other aspects of the present disclosure will become apparent from the following descriptions when considered in conjunction with the accompanying drawings.

DETAILED DESCRIPTION

Figure 1:
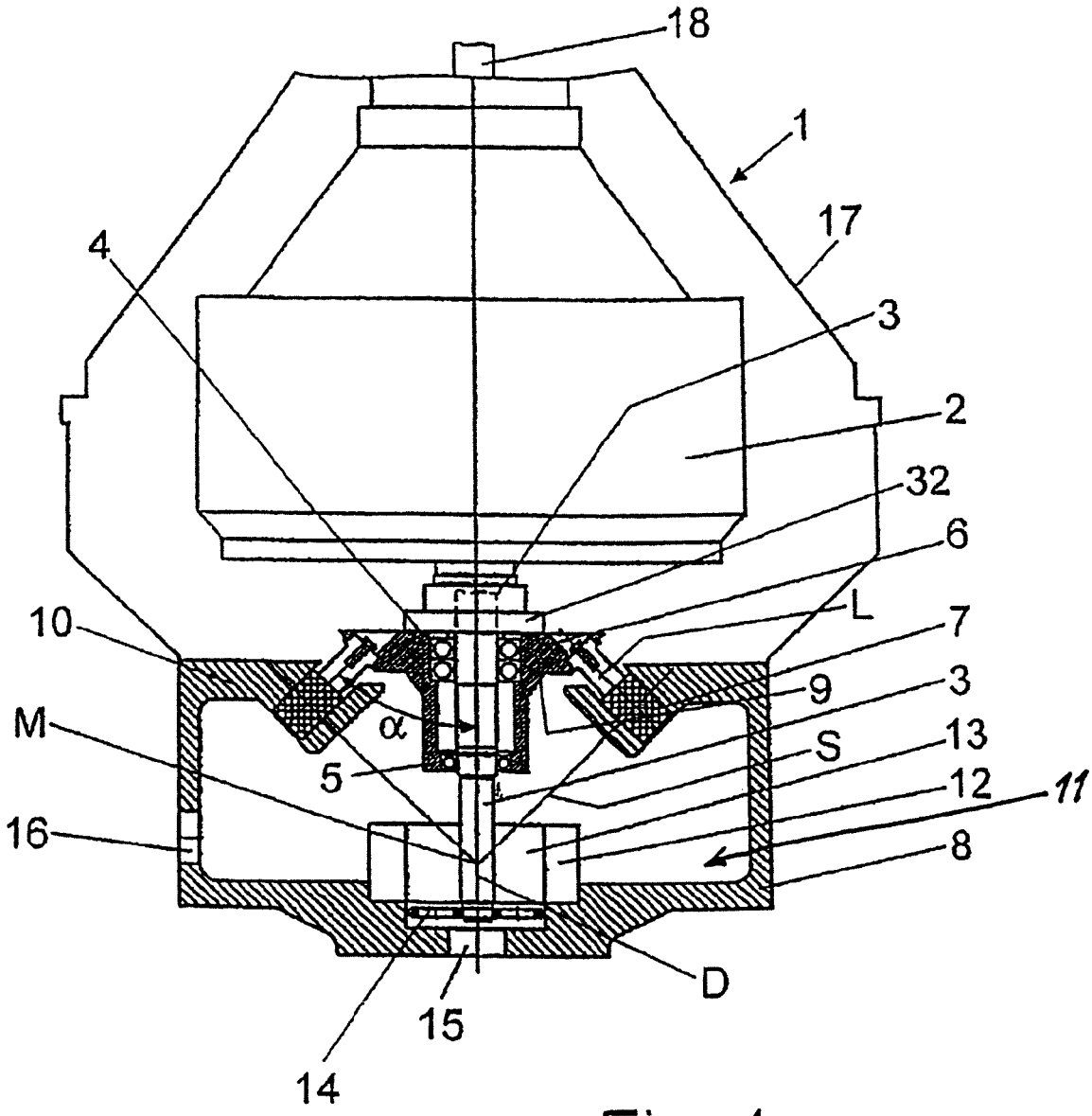
FIG. 1 is a sectional view of a first embodiment of a separator, according to the present disclosure.

FIG. 1 shows a separator 1 with a centrifuge drum 2 with a vertical rotational axis D and which is surrounded by a hood arrangement 17. The centrifuge drum 2 is fitted onto a drive spindle 3. The drive spindle 3 is rotatably mounted in a housing 6 by a bearing arrangement or device which comprises an upper or neck bearing 4 and a lower or footstep bearing 5. For example, the neck bearing 4 has two roller bearings. It is within the scope of the present disclosure that neck bearing 4 would include just one roller bearing.

A drive area is shown in section underneath a bearing cover 32. The spindle 3 is not shown in an area of the drum 2 and hood 17.

A feed line, or feed pipe 18, permits fluid to be fed into the drum 2 into which a disk stack is inserted and which is configured for continuous operation (not shown).

The housing 6 is supported on a machine frame 8 by elastic elements, such as ultra sockets 7. A plurality of the ultra sockets 7 are distributed around a circumference between a flange 9 of the housing 6 and an upper wall 10 of the machine frame 8, with longitudinal axes L of the ultra sockets 7 being aligned at an angle to the drive spindle 3. An angle α between the drive spindle 3 or the rotational axis D and the ultra sockets 7 is between 30° and 60°.

A separator drive includes an electric motor 11 which has a motor housing with a stator 12 or a stator winding and a motor rotor 13 to provide drive. The motor 11 does not have a separate bearing, which permits a relatively cost-effective design. The bearing device, or bearing arrangement, is arranged between the motor 11 and the drum 1. The motor rotor 13 is therefore arranged in a simple and advantageously overhung fashion with respect to the drive spindle 3. It is, therefore, surprisingly possible to dispense with separate bearings on the motor 11 for implementing rigid positioning of the motor rotor 13 with respect to the stator 12 of the motor 11. Those separate bearings are otherwise provided in motors for other separators.

The drive spindle 3 is connected directly without intermediate elements, such as a clutch, to the motor rotor 13. A housing of the motor 11 is, in contrast, arranged or supported on the machine frame 8 in a rigid and unsprung fashion.

In this way, the centrifuge drum 1 with the drive spindle 3, the motor rotor 13 and the housing 6 form an oscillating system or unit which is supported elastically on the machine frame 8, but which does not include the stator 12, so that relative movements occur between the motor rotor 13 and the stator 12.

The separator drive is configured in such a way that a center of rotation M of the oscillating system, in which the centrifuge drum 2 carries out, inter alia, a precision movement during operation, is in the axial and radial center point of the motor rotor 13. The center of rotation M and the center point coincide exactly, as shown in FIG. 1. However, it is within the scope of the present disclosure for them to differ slightly from one another as long as it is ensured that the motor rotor 13, which oscillates along with the drive spindle 3, can still rotate freely in the stator 12 without touching it.

The position of the center of rotation M of the oscillating system or of the oscillating unit is defined by the ultra socket 7 and their arrangement. Perpendiculars S intersect through the center of the longitudinal axes L of the ultra sockets 7 precisely at the center of rotation M.

As a result of this measure, the separator drive is configured in such a way that the relative movements which occur between the stator 12 and the motor rotor 13 during operation are reduced to a minimum.

At a lower end of the drive spindle 3, an impeller wheel 14 is arranged, which impeller wheel 14 sucks air in from below through a frame opening 15 in the machine frame 8, feeds air through the motor 11 and blows it out at a further opening 16 in the machine frame 8.

In order to generate a sufficient difference in pressure, the stator 12 is embodied so as to be sealed in the downward direction with respect to the machine frame 8. The feed or frame opening 15 is positioned directly under the drive spindle 3. In this way, the impeller wheel 14 can be used to implement a pump-like design in a simple way.

It is within the scope of the present disclosure that the impeller wheel 14 could also be driven with a separate, for example, small, drive so that an "extraneous ventilator", such as an independent ventilation means which is decoupled from the drive spindle, would be implemented. An advantage of this configuration is ventilation independent of the rotational speed of the motor rotor 13, so that uniform cooling would be ensured.

If an air stream is not desired, it is within the scope of the present disclosure that a cooling device with water can also be installed, as is used by water-cooled motors. The machine frame 8 can then be of a correspondingly sealed design.

Figure 2:
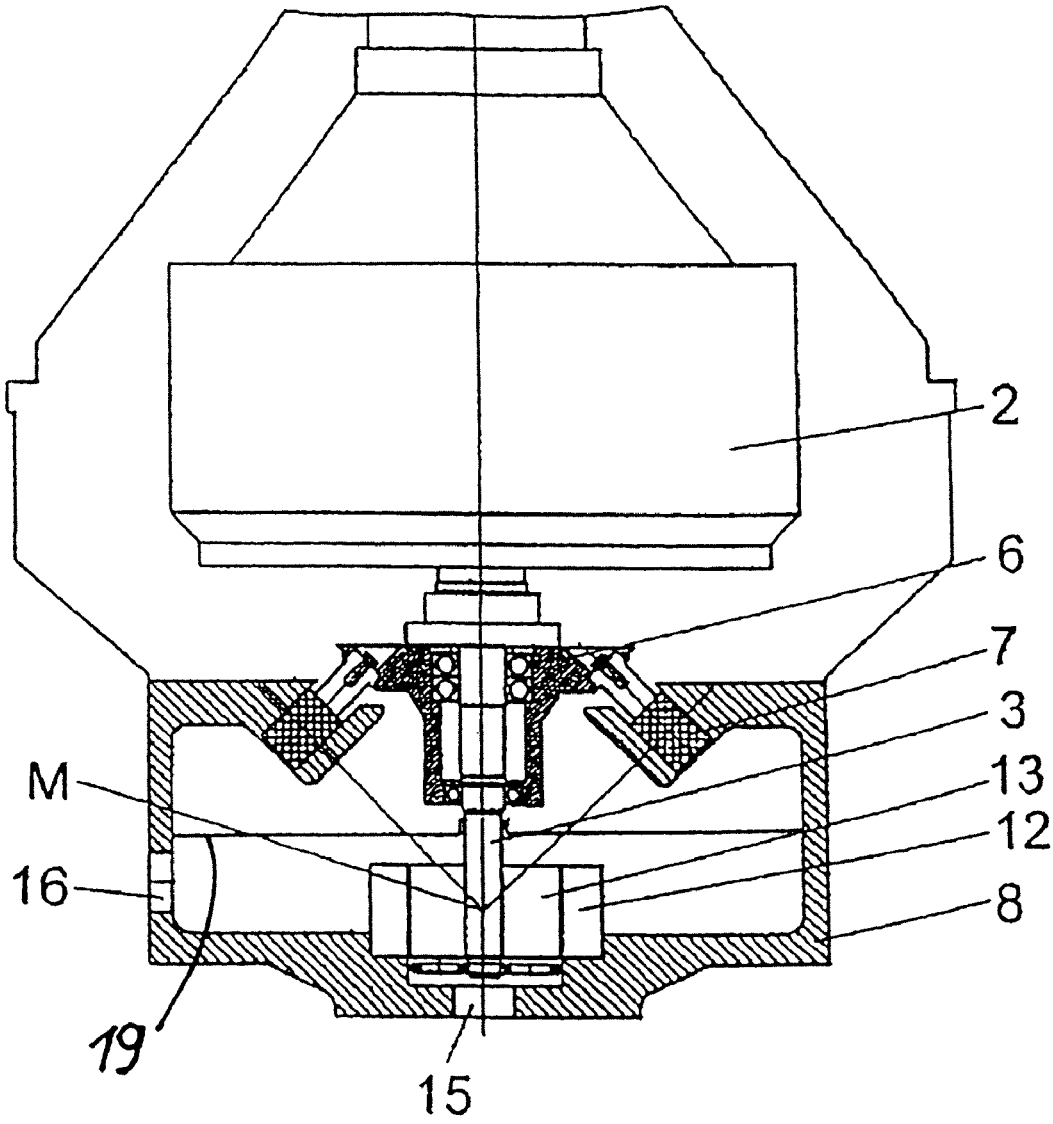
FIG. 2 is a sectional view of a second embodiment of a separator, according to the present disclosure.

FIG. 2 shows another embodiment of a separator, according to the present disclosure, in which a dividing wall 19 in the machine frame 8 divides an upper axial section, in which the motor 11 is accommodated, from a lower axial section which accommodates the bearing device that includes the neck bearing 4 and the footstep bearing 5. The dividing wall 19 extends right up to the drive spindle 3 but does not rotate along with it. The frame opening 15, for sucking in air through the motor 11, and the frame opening 16, for outputting this air, are both arranged in the lower axial section of the machine frame 8 underneath the dividing wall 19. It is within the scope of the present disclosure that the machine frame 8 can be embodied so as to be closed, with the exception of the frame openings 15 and 16 in the lower section.

In contrast, lubrication means of the bearing devices is accommodated in the upper section above the dividing wall 19 not shown.

Figure 3:
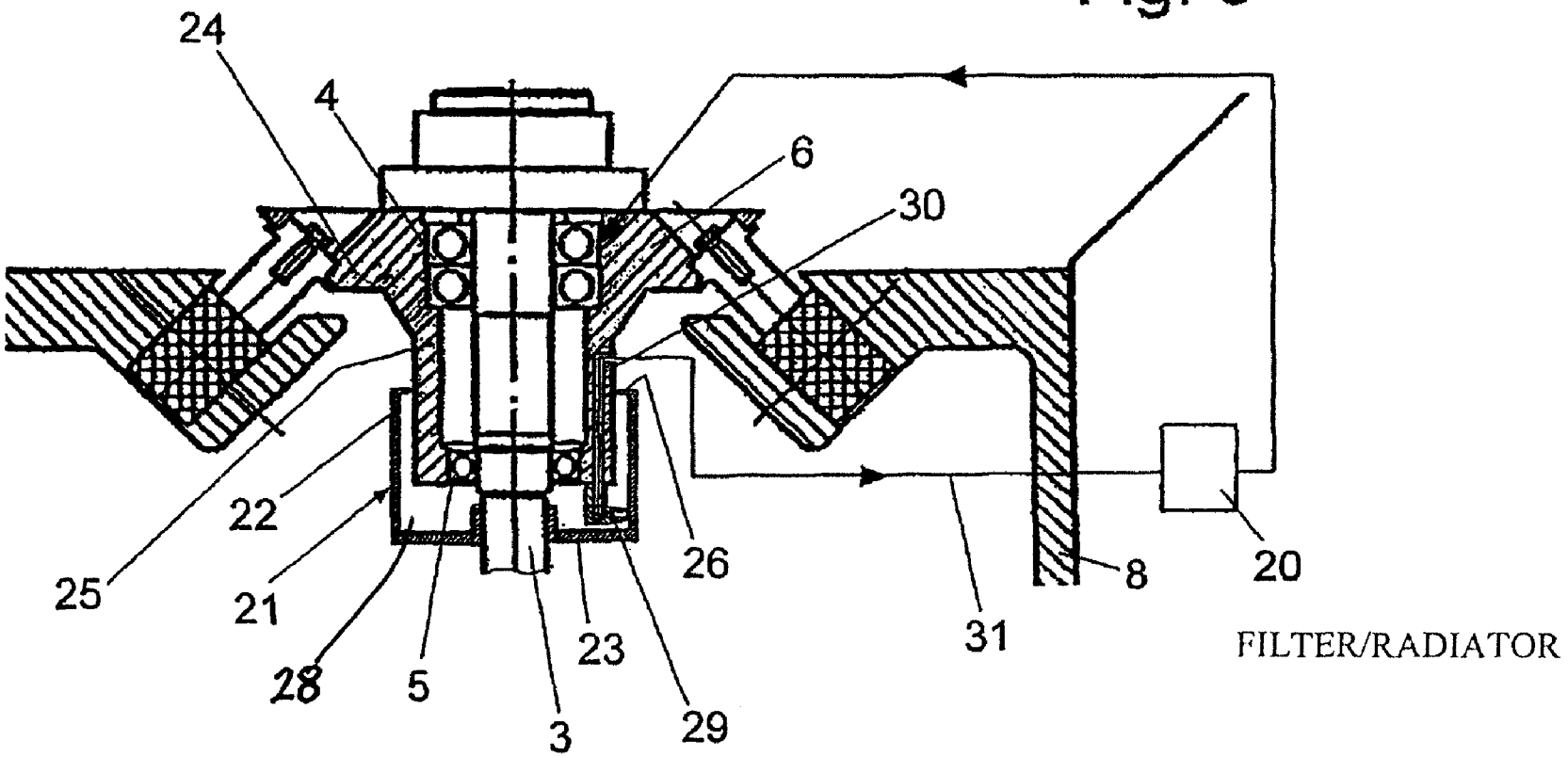
FIG. 3 is a sectional view of a third embodiment of a separator, according to the present disclosure.

Another embodiment, according to the present disclosure, is shown in FIG. 3. Some of the elements of this embodiment, which are not illustrated here, are embodied in essentially the same way as the separators shown in FIGS. 1 and 2.

The bearing device, including bearings 4 and 5, for the drive spindle 3 as shown in FIG. 1, completely arranged above the motor 11.

As shown in FIG. 3, a pot-shaped sleeve 21 is attached to the drive spindle 3 and is connected to the drive spindle 3 in a rotationally fixed fashion. In this context, the sleeve 21 has an upper, internally hollow sleeve section 22 and a lower disk section 23 which is connected to the drive spindle 3 and which is penetrated by the drive spindle 3 in the downward direction.

The bearing housing 6 has an upper flange 24 and a lower sleeve-like housing section 25 which engages through an upper opening in the machine frame 8 and which engages with its lower end into the upwardly open sleeve 21. The motor 11 is arranged underneath the sleeve 21 (not shown).

As a result of the rotation of the spindle 3, oil for lubricating the bearings 4, 5 of the bearing device collects on an inner lateral surface of the sleeve section 22 of the sleeve 21 during operation.

An inwardly projecting, circumferential collar 26 is formed at an upper end of the sleeve section 22. As a result, a ring-like lubrication space 28 for accommodating a film of lubricant is formed between the inner upper collar 26, the inner circumferential edge of the sleeve section 22, the lower disk section 23 and the drive spindle 3.

A tube-like attachment or projection 29, which extends radially from the lower sleeve-like section of the bearing housing 6 outward into the lubricant space 28, projects into said lubricant space 28. The tube-like attachment or projection 29 continues into a discharge duct 30 for the lubricant. Thus is done in the manner of a pump or similar to a skimming. Tube-like attachment 29 is not entrained in rotation and firstly extends radially inward and then upward in the bearing housing 6 and exits the bearing housing 6.

By the skimming-disk-like projection 29, with the drainage duct 30 arranged downstream, it is possible to drain lubricant under pressure out of the lubricant space 28. This is done in a pump-like fashion when the drum 2 or the spindle 3 rotates, which feeds said lubricant back into the bearing device, for example, via a line 31 which is connected downstream of the non-rotating bearing housing 6, without mist or spray being produced. Assemblies of a wide variety of types can be connected into the line 31, for example a filter 20 and/or a radiator. As a result of the pump-like effect, it is advantageously possible to dispense with a separate or external pump as an assembly. However, it is within the scope of the present disclosure to provide such a pump in order, for example, to feed the oil to the lubrication means in roller bearings of the bearing device (not shown).

As shown in FIG. 3, it is also possible to dispense with the intermediate or dividing wall 19 (see FIG. 2) since the sleeve 21 itself closes off the lubricant area for the bearing device.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A separator comprising:

a centrifuge drum having a vertical rotational axis and including a feed line to feed a product to be centrifugally processed;

a drive spindle to drive the centrifugal drum, which drive spindle is rotatably mounted in a housing by a bearing device and which is supported on a machine frame by an elastic support;

a drive device including an electric drive motor having a stator and a motor rotor which is aligned with the drive spindle;

wherein the stator is rigidly connected to the machine frame;

wherein the motor rotor, the drive spindle, the centrifuge drum, and the housing form a unit which is supported on the machine frame by the elastic support and which unit oscillates during an operation of the separator; and wherein the bearing device is arranged between the motor and the drum;

wherein the elastic support includes ultra sockets which have a longitudinal axis oriented at an angle to one or both of the rotational axis and the drive spindle; and wherein the ultra sockets are oriented at an angle of 30 to 60° to the rotational axis.

2. The separator as claimed in claim 1, wherein the drive device is configured in such a way that a center of rotation of the oscillating unit is at an axial and radial center point of the motor rotor.

3. The separator as claimed in claim 2, wherein the center of rotation and the radial center point differ from one another to such an extent that the motor rotor, which oscillates along with the drive spindle, rotates freely in the stator without touching the stator.

4. The separator as claimed in claim 1, wherein the motor rotor is directly connected to the drive spindle in a rotationally fixed fashion.

5. The separator as claimed in claim 1, wherein the bearing device comprises a neck bearing and a footstep bearing.

6. The separator as claimed in claim 1, wherein an impeller wheel is arranged at a lower end of the drive spindle.

7. The separator as claimed in claim 6, wherein the impeller wheel is arranged and configured in such a way that it sucks in air from surroundings of the machine frame from below through a first frame opening in the machine frame.

8. The separator as claimed in claim 7, wherein the machine frame includes a second frame opening for outflowing air.

9. The separator as claimed in claim 7, wherein the stator is configured so as to be sealed in a downward direction with respect to the machine frame, and such that the first frame opening is positioned directly under the drive spindle.

10. The separator as claimed in claim 7, wherein a dividing wall in the machine frame divides the machine frame into a lower axial section, in which the motor is accommodated, and an upper axial section which holds the bearing device.

11. The separator as claimed in claim 10, wherein the first frame opening and the second frame opening are both arranged in the lower axial section of the machine frame underneath the dividing wall.

12. The separator as claimed in claim 10, wherein the machine frame extends in the lower axial section underneath the dividing wall so as to include the first and second frame openings.

13. The separator as claimed in claim 10, wherein the bearing device is lubricated in an area above the dividing wall.

14. The separator as claimed in claim 1, wherein the motor does not include its own bearing device.

15. The separator as claimed in claim 1, wherein the motor rotor is arranged in an overhung fashion with respect to the drive spindle.

16. The separator as claimed in claim 1, wherein the motor rotor is constructed integrally with the drive spindle.

17. A separator comprising:

a centrifuge drum having a vertical rotational axis and including a feed line to feed a product to be centrifugally processed;

a drive spindle to drive the centrifugal drum, which drive spindle is rotatably mounted in a housing by a bearing device and which is supported on a machine frame by an elastic support;

a drive device including an electric drive motor having a stator and a motor rotor which is aligned with the drive spindle;

wherein the stator is rigidly connected to the machine frame;

wherein the motor rotor, the drive spindle, the centrifuge drum, and the housing form a unit which is supported on the machine frame by the elastic support and which unit oscillates during an operation of the separator; and wherein the bearing device is arranged between the motor and the drum;

wherein the elastic support includes ultra sockets which have a longitudinal axis oriented at an angle to one or both of the rotational axis and the drive spindle; and wherein perpendiculars through a center of the longitudinal axis of the ultra sockets intersect at a center point of the motor rotor.

18. A separator comprising:

a centrifuge drum having a vertical rotational axis and including a feed line to feed a product to be centrifugally processed;

a drive spindle to drive the centrifugal drum, which drive spindle is rotatably mounted in a housing by a bearing device and which is supported on a machine frame by an elastic support;

a drive device including an electric drive motor having a stator and a motor rotor which is aligned with the drive spindle;

wherein the stator is rigidly connected to the machine frame;

wherein the motor rotor, the drive spindle, the centrifuge drum, and the housing form a unit which is supported on the machine frame by the elastic support and which unit oscillates during an operation of the separator;

wherein the bearing device is arranged between the motor and the drum;

wherein a pot-shaped sleeve is connected to the drive spindle in a rotationally fixed fashion and is penetrated by the drive spindle in a downward direction; and wherein the pot-shaped sleeve includes an upper, internal hollow sleeve section and a lower disk section which is connected to the drive spindle, and the housing includes a lower, sleeve-like housing section which engages in the sleeve.

19. The separator as claimed in claim 18, wherein a circumferential collar, which projects inward, is formed at an upper end of the internal hollow sleeve section.

20. A separator comprising:

a centrifuge drum having a vertical rotational axis and including a feed line to feed a product to be centrifugally processed;

a drive spindle to drive the centrifugal drum, which drive spindle is rotatably mounted in a housing by a bearing device and which is supported on a machine frame by an elastic support;

a drive device including an electric drive motor having a stator and a motor rotor which is aligned with the drive spindle;

wherein the stator is rigidly connected to the machine frame;

wherein the motor rotor, the drive spindle, the centrifuge drum, and the housing form a unit which is supported on the machine frame by the elastic support and which unit oscillates during an operation of the separator;

wherein the bearing device is arranged between the motor and the drum;

wherein a pot-shaped sleeve is connected to the drive spindle in a rotationally fixed fashion and is penetrated by the drive spindle in a downward direction;

wherein the sleeve bounds a lubricant space; and wherein a tube-like attachment extends radially from the lower, sleeve-like housing section of the housing outward into the lubricant space and continues into a discharge duct for the lubricant in a manner of a pump or similar to a skimming, which tube-like attachment is not entrained in rotation.

* * * * *